US005304966A

United States Patent [19]

Hino et al.

[11] Patent Number: 5,304,966

[45] Date of Patent: Apr. 19, 1994

[54] METHOD OF ADJUSTING A FREQUENCY RESPONSE IN A THREE-CONDUCTOR TYPE FILTER DEVICE

[75] Inventors: Seigo Hino; Kenji Ito, both of Nagoya, Japan

[73] Assignee: NGK Spark Plug Co., Ltd., Nagoya, Japan

[21] Appl. No.: 59,280

[22] Filed: May 11, 1993

[30] Foreign Application Priority Data

May 13, 1992 [JP] Japan ..... 4-148143

[51] Int. Cl.[5] ..... H01P 1/203

[52] U.S. Cl. ..... 333/204; 333/205

[58] Field of Search ..... 333/203-205, 333/219, 235, 246, 238

[56] References Cited

U.S. PATENT DOCUMENTS 4,157,517 6/1979 Kneisel et al. ..... 333/205

5,075,653 12/1991 Ito et al. ..... 333/205

*Primary Examiner*—Seungsook Ham

*Attorney, Agent, or Firm*—Larson and Taylor

[57] ABSTRACT

A method of adjusting a frequency response in a filter device of a three-conductor type having a pair of stacked dielectric substrates with a plurality of strip-line resonator conductors being sandwiched therebetween, wherein the frequency adjusting of the filter is performed by partially removing the external ground conductor layer on the peripheral surface of each substrate at a region corresponding to a longitudinal side edge of each resonator conductor layer.

5 Claims, 4 Drawing Sheets

METHOD OF ADJUSTING A FREQUENCY RESPONSE IN A THREE-CONDUCTOR TYPE FILTER DEVICE

BACKGROUND OF THE INVENTION

The present invention relates to a method of adjusting a frequency response in a filter device of three-conductor type which may be used as a band-pass filter for example.

It is known to provide a filter device of three-conductor type which is utilized as a band-pass filter for a microwave range. An example of such a conventional filter device is illustrated in FIGS. 1 and 2. As will be seen in FIGS. 1 and 2, it comprises a lower dielectric substrate 1 and an upper dielectric substrate 2 which are stacked to each other. Each of the dielectric substrates 1 and 2 may be of dielectric ceramic material having a high dielectric constant and a lower dielectric loss such as $BaO—TiO_2$, $BaO—TiO_2$-rare earth or the like. The lower dielectric substrate 1 is provided with an external ground conducting layer 3 on the peripheral portion and bottom surface thereof. Similarly, the upper dielectric substrate 2 is provided with an external ground conducting layer 4 on the peripheral portion and upper surface thereof. On the upper surface of the lower dielectric substrate 1 are disposed a plurality of stripline resonator conducting layers 5, 6 and 7 which form a filter element. Each resonator conducting layer has one end or an open circuit end (5*a*, 6*a* and 7*a*) spaced from the ground conducting layer 3 and the other end or a short circuit end (5*b*, 6*b* and 7*b*) connected to the ground conducting layer 3. The open circuit ends 5*a*, 6*a* and 7*a* of the respective resonator conducting layers 5, 6 and 7 are alternately disposed so as to form an interdigitated configuration. The upper dielectric substrate 2 is fixed on the lower dielectric substrate 1, and the ground conducting layers 3 and 4 of the respective dielectric substrates are connected to each other.

As well known in the art, the filter device of this type has a frequency response which depends on the configuration and dielectric constant of the substrates, and the dimension of the resonator conductors. Upon the manufacturing of the filter device the dielectric constant of the substrates and the size of the resonator conducting layers are strictly determined. However, it can not be avoided that there may occur any dispersions in the dielectric constant of the substrates and in the dimension of the resonator conducting layers. It is, therefore, necessary to adjust the frequency response of the filter device after being completed.

The adjustment of the frequency response can not be performed by adjusting the length of the resonator conducting layers because they are embeded in the dielectric substrates. One solution to this problem has been proposed in U.S. Pat. No. 4,157,517. According to the adjusting method disclosed in this patent, the frequency of the filter is previously set at a lower level than a desired one, and the external conductor or ground conducting layer 4 provided on the upper surface of the upper substrate 2 is partially removed at regions 8 adjacent the open circuit ends of the resonator conducting layers 5, 6 and 7 to reduce the capacitance between the external conducting layer 4 and the respective resonator conducting layers and to increase the response frequency of the filter thereby making it possible to adjust the frequency.

However, with this adjusting method, when the assembled filter is to be contained in an outer casing 9 after the adjustment of the frequency response is made, the removed regions 8 for the frequency adjustment of the upper surface of the upper dielectric substrate 2 come close to or come into contact with the upper wall of the outer casing 9 because the removed regions 8 are positioned on the upper surface of the upper dielectric substrate 2. Therefore, the stray capacitance may be changed from the adjusted value so that the frequency response may be deviated. For this reason, if the above mentioned adjusting method is applied, the outer casing should be so designed that it has an inner height larger than the height of the filter assembly and the upper surface of the upper dielectric substrate 2 is sufficiently spaced from the upper wall of the casing 9 as will be seen in FIG. 2.

Recently, various equipments or elements adapted for use in a microwave range become thinner and it is thus demanded that the filter devices as well as the elements should be constructed in a thinner configuration or dimension.

However, such a demand for a thinner construction can not be satisfied by utilizing the above mentioned adjusting method in which a casing having a larger inner height is necessarily used.

FIG. 3 illustrates a previously proposed frequency response adjusting method for meeting such a demand for a thinner construction of a filter device of a three-conductor structure type having a pair of dielectric substrates 11 and 12 each having a peripheral and outer surfaces provided with an external ground conducting layer 13; 14, and a plurality of stripline resonator conducting layers 15, 16 and 17 sandwiched between the dielectric substrates 11 and 12, each resonator conducting layer having an open circuit end 15*a*; 16*a*; 17*a* spaced from the ground conducting layers 13 and 14 and a short circuit end 15*b*; 16*b*; 17*b* connected to the ground conducting layers 13 and 14 wherein the external ground conducting layer 13; 14 on the peripheral surface of each substrate is partially removed at a portion 13*a*; 14*a* which corresponds to the open circuit end of each resonator conducting layer or at a portion which corresponds to the short circuit end of each resonator conducting layer, thereby tuning the filter device for a desired frequency response. This frequency adjusting method is disclosed in U.S. Pat. No. 5,075,653.

However, this previously proposed method has a disadvantage that an adjustable range is limited because the variation of the frequency is smaller as compared with the area of the removed external ground conducting layer portions and the frequency adjustment can be made only at the region across the width of each resonator conducting layer.

SUMMARY OF THE INVENTION

It is therefore an object of the present invention to provide a method of adjusting a frequency response of a filter device of a three-conductor structure type in which a frequency can be widely changed or adjusted by removing a smaller area of ground conductor layer.

Another object of the invention is to provide a filter device of a three-conductor structure type which fully meets with the requirement for smaller and thinner dimension and has a wide adjusting range.

According to one aspect of the present invention, there is provided a method of adjusting a frequency response of a filter device of a three-conductor structure type including a pair of dielectric substrates each having a peripheral and outer surfaces provided with an external ground conductor layer, and a plurality of stripline resonator conductor layers sandwiched between the dielectric substrates, each resonator conductor layer having a short circuit end connected to the ground conductor layer on one lateral surface of each substrate and an open circuit end spaced from the ground conductor layer on the opposite lateral surface of each substrate, wherein it comprises the step of partially removing the external ground conductor layer on the peripheral surface of each substrate at a region which corresponds to a longitudinal side edge of each resonator conductor layer to form a ground conductor removed portion partially extending along the region between the open circuit end and the short circuit end of each outer resonator conductor layer, thereby tuning the filter device for a desired frequency response.

Each of the dielectric substrates may be provided with recesses on the side portions which are opposite to the longitudinal side portions of both the outermost resonator conductor layers, and each of the removed portion may be formed on the associated recess.

In the method of the present invention an additional conductor member may be provided on each of the removed portions for compensating any overshoot of the adjustment performed by the removing step.

By removing partially the external ground conducting layer on the peripheral surface of each substrate at a portion which corresponds to the longitudinal side edge of each resonator conductor layer, the capacitance between each removed portion and the associated open circuit end of each resonator conductor layer is reduced.

According to another aspect of the present invention, there is provided a filter device of a three-conductor structure type comprising a pair of dielectric substrates having a peripheral and outer surfaces; an external ground conductor layer provided on the peripheral and outer surfaces of each of said dielectric substrates; a plurality of stripline resonator conductor layers sandwiched between said dielectric substrates, each resonator conductor layer having a short circuit end connected to said ground conductor layer on one lateral surface of each substrate and an open circuit end spaced from said ground conductor layer on the opposite lateral surface of each substrate, said external ground conductor layer provided on the peripheral surface of said each dielectric substrate having a portion removed therefrom which extends along a region between the open circuit end and the short circuit end of each outer resonator conductor layer for changing a capacitance between said ground conductor layer and each of said stripline resonator conductor layers sandwiched between said dielectric substrates; and a casing for containing a filter assembly of said dielectric substrates and said resonator conductor layers, said casing having an inner height equal to the thickness of said filter assembly.

The present invention will now be described by way of example with reference to the accompanying drawings.

DETAILED DESCRIPTION

Figure 4:
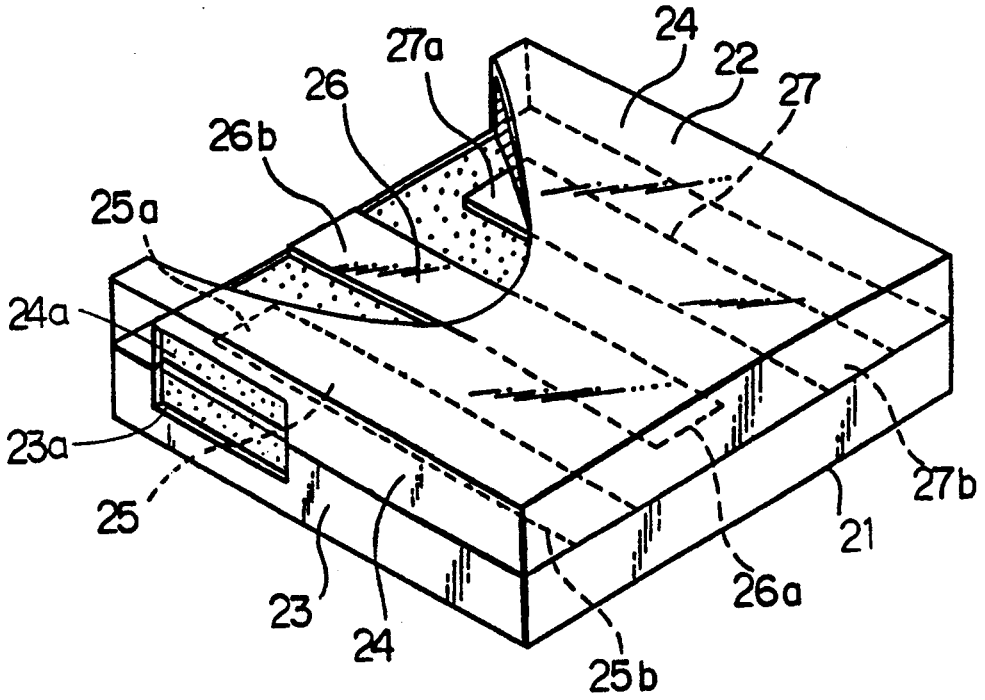
FIG. 4 is a perspective partially cutaway view schematically showing a filter whose frequency response is adjusted in accordance with an embodiment of the present invention.
Figure 5:
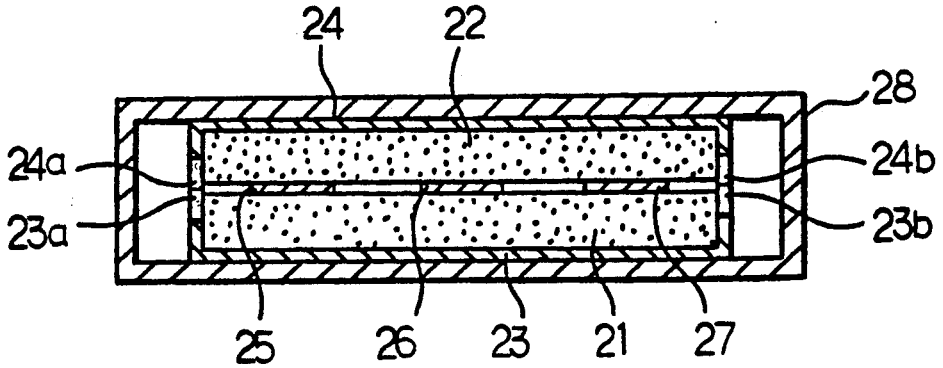
FIG. 5 is a cross section showing the filter device of FIG. 4 contained in a casing.

FIGS. 4 and 5 show a three-conductor type filter constructed in accordance with an embodiment of the present invention.

The illustrated filter comprises a lower and upper dielectric substrates 21 and 22 which are stacked to each other upon the assembling of the filter. Each of the dielectric substrates 21 and 22 may be of dielectric ceramic material having a high dielectric constant and a lower dielectric loss such as $BaO—TiO_2$, $BaO—TiO_2$-rare earth or the like. The lower dielectric substrate 21 is provided with an external ground conductor layer 23 on the peripheral portion and outer surface thereof. Similarly, the upper dielectric substrate 22 is provided with an external ground conductor layer 24 on the peripheral portion and upper or outer surface thereof. On the upper or inner surface of the lower dielectric substrate 21 are provided a plurality of stripline resonator conductor layers 25, 26 and 27. In this connection, it is substantially unavoidable that there may occur any deviations in the dielectric constants of the used substrates and/or in the dimension of the resonator conductor layers upon the manufacturing, which results in that the frequency response of the completed filter may be deviated from an intended one. Therefore, the dimensions of resonator conductor layers 25, 26 and 27 are determined so that the resonance frequency of the filter becomes slightly lower than the intended one. Each resonator conductor layer has one end or an open circuit end 25*a*; 26*a*; 27*a* spaced from the ground conductor layer 23 and the other end or a short circuit end 25*b*; 26*b*; 27*b* connected to the ground conductor layer 23. The open circuit ends 25*a*, 26*a* and 27*a* of the respective resonator conductor layers 25, 26 and 27 are alternately disposed so that the respective resonator conductor layers 25, 26 and 27 form a filter element of an interdigital type. The upper dielectric substrate 22 is fixed on the lower dielectric substrate 21, and the ground conductor layers 23 and 24 of the respective dielectric substrates are connected to each other.

With the three-conductor type filter thus prepared in order to compensate any deviations in the dielectric constants of the used dielectric substrates 21 and 22 and in the length of each resonator conductor layer it is necessary to adjust the frequency of the filter after the dielectric substrates 21 and 22 are assembled with the resonator conductor layers sandwiched therebetween. To this end, the external ground conductor layer provided on the peripheral surface of each substrate is partially removed at a portion 23*a*; 24*a* which corresponds to the longitudinal side edge portion of each of the outermost resonator conductor layers 25 and 27 longitudinally towards the short circuit end from the open circuit end of the associated resonator conductor layer so as to form a ground conductor removed portion. As a result, the capacitance between each removed portion and the associated resonator conductor layer can be reduced, and thus the center frequency is shifted towards a higher frequency zone so that it becomes identical with the desired response frequency. In this way, the filter can be tuned to a desired frequency response.

This removing operation may be performed by means of a cutting tool, a laser beam machining, a sand blasting or the like.

The assembled filter is designed to have a center frequency which is slightly lower than a desired response frequency before the frequency adjustment is made. By removing the portions 23*a* and 24*a*; 23*b* and 24*b* of the external ground conductor layers 23 and 24 which correspond to the longitudinal side edge portion of each of the outermost resonator conductor layers 25 and 27, it is possible to adjust the frequency response to a desired level.

Then, the three-conductor type filter thus adjusted to the desired frequency response is contained in a casing 28 as shown in FIG. 5. The casing 28 has an inner height equal to the height of the filter and a width larger than that of the filter. By selecting the dimension of the casing 28 in this way, the filter device can be constructed without any substantial increasing of the height, and the peripheral portion of the filter on which the removed portion is formed can be prevented from bringing into contact with the inner surface of the casing 28 so that any variation of a stray capacitance which may occur later can be avoided. In this case, even if the width of the casing 28 is set larger than that of the filter, the requirement for thinner dimension for electronic circuit elements can be effectively satisfied.

Then, there may occur that the center frequency of the filter is shifted over the desired one by the provision of the removed portions on the external ground conductor layers 23 and 24 provided on the peripheral surface of the respective substrates 21 and 22 in accordance with the embodiment of the present invention. In order to compensate this overshoot, a ground or additional conductor material 29 (shown with a broken line) may be applied to the removed portions by means of any suitable method. Alternatively, the external ground conductor layers 23 and 24 provided on the peripheral surfaces of the substrates 11 and 12 may be partially removed at regions contacted with the short circuit ends 25*b*, 26*b* and 27*b* of the resonator conductor layers 25, 26 and 27. This removing operation may also be performed by means of a cutting tool, a laser beam machining, a sand blasting or the like. Therefore, the capacitance between each removed portion and the associated resonator conductor layer is reduced, and thus the center frequency is shifted toward a lower frequency zone so that it becomes identical with the desired response frequency.

With the illustrated embodiments shown in FIGS. 4 and 5, the upper dielectric substrate 22 may also be provided with a transmission line pattern of resonator conductor layers on the lower surface, which is disposed to have a reflected image relation with respect to the stripline pattern of the resonator conductor layers 25, 26 and 27 on the lower dielectric substrate 21. When being assembled the stripline pattern on the lower dielectric substrate 21 comes into face-to-face contact with the transmission line pattern on the upper dielectric substrate 22 without occurring any gaps between the lower dielectric substrate 21 and the upper dielectric substrate 22.

Further, the stripline pattern of the resonator conductor layers 25, 26 and 27 may be formed as a comb type in which the open circuit ends and the short circuit ends thereof are disposed at the same sides, respectively.

Figure 6:
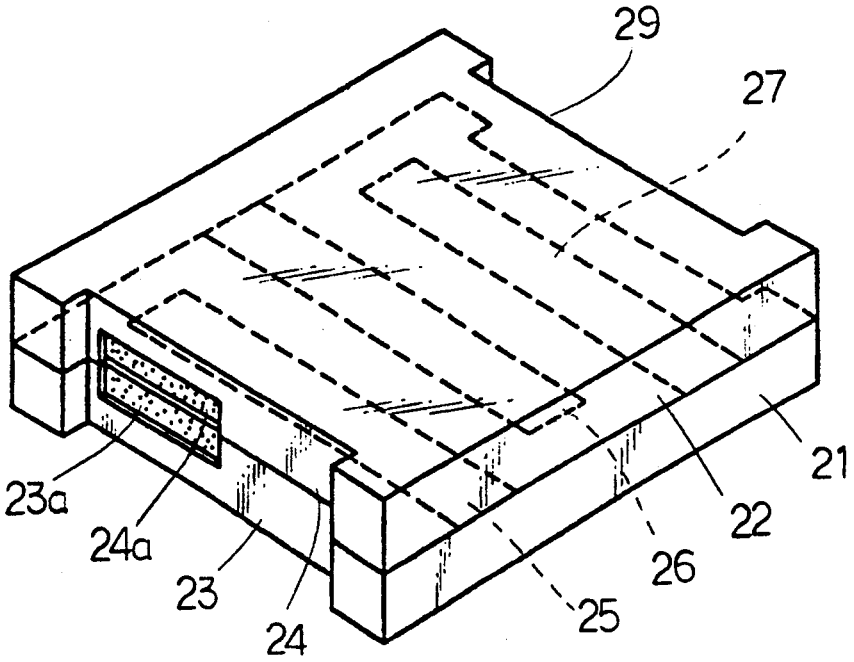
FIG. 6 is a perspective partially cutaway view schematically showing a filter whose frequency response is adjusted in accordance with another embodiment of the present invention.

FIG. 6 illustrate another embodiment of the present invention in which there is no need of enlarging the width of the casing within which the filter is contained.

As illustrated in FIG. 6, recesses 29 are provided on the side portions of the dielectric substrates 21 and 22 which are opposite to the longitudinal side portions of both the outermost resonator conductor layers 25 and 27. In this embodiment the adjustment of the frequency response can be performed by partially removing the portions of the ground conductor layers 23 and 24 provided on these recesses 29 as designated by 23*a* and 24*a*. When the filter is inserted into the casing not shown, the removed portions 23*a* and 24*a* can be spaced from the inner wall surface of the casing, and thus the portions of the dielectric substrates 21 and 22 exposed through the removed portions 23*a* and 24*a* can be prevented from bringing into contact with the inner wall surface of the casing. Therefore, the capacitance between the ground conductor layer and the associated resonator conductor layer is not changed when the filter is inserted into the casing, and thus the frequency response of the filter can be stably maintained at the desired level without necessity of any readjustment.

With this embodiment, alternatively, each of the inner walls of the casing is outwards protruded at regions faced to the portions to be removed for the frequency adjustment so as to form inner recesses, thereby preventing the portions of the dielectric substrates 21 and 22 exposed through removed portions from bringing into contact with the associated inner surface of the casing.

Figure 1:
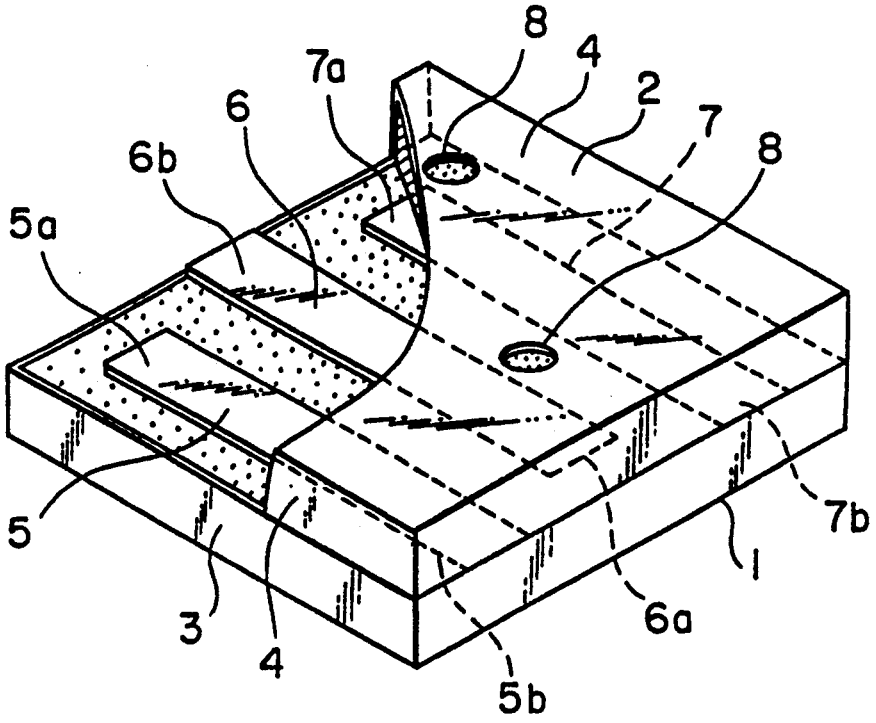
FIG. 1 PRIOR ART
FIG. 1 is a perspective partially cutaway view showing a prior art three-conductor type filter device.
Figure 2:
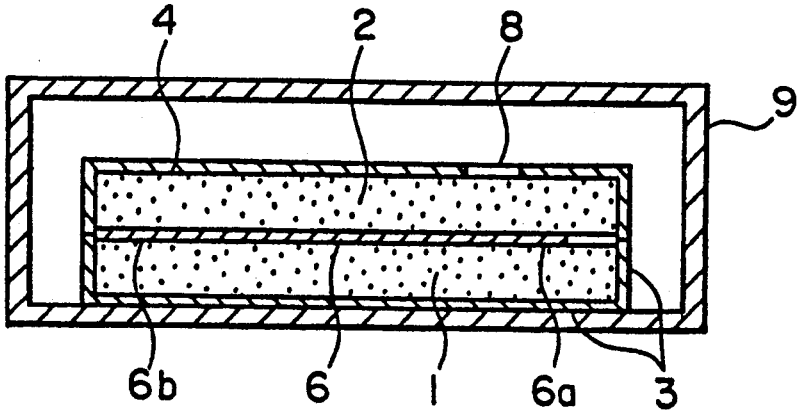
FIG. 2 PRIOR ART
FIG. 2 is a longitudinal section showing the filter device of FIG. 1 contained in a casing.
Figure 3:
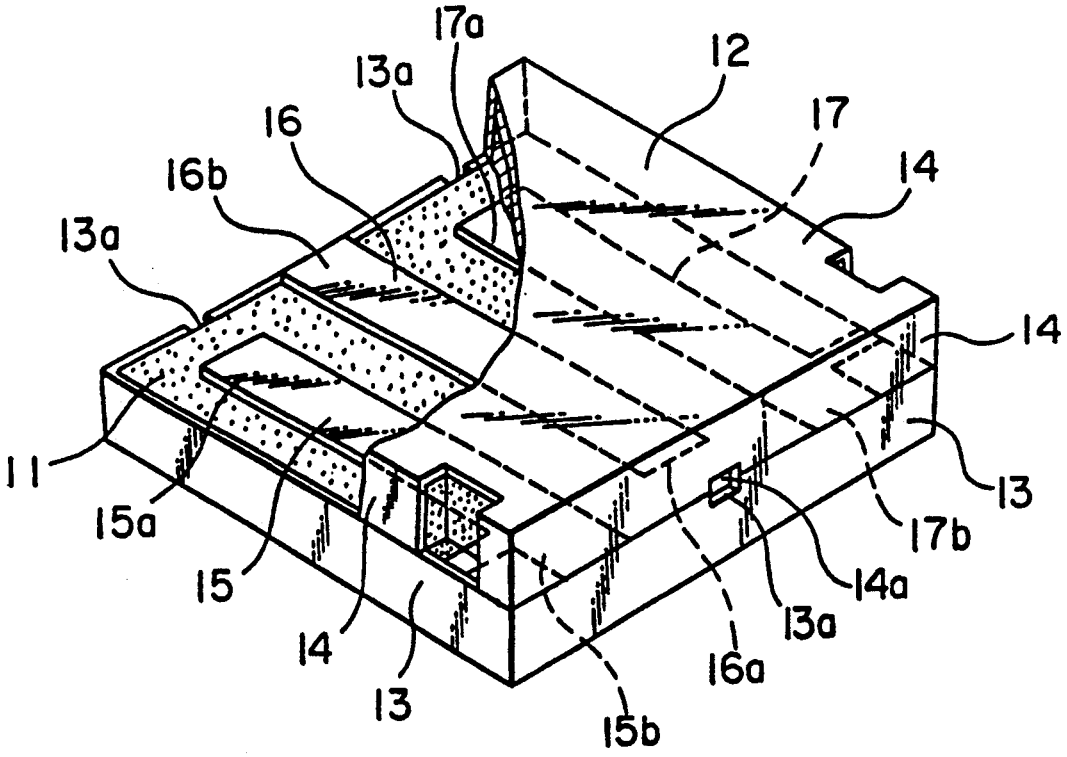
FIG. 3 PRIOR ART
FIG. 3 is a perspective partially cutaway view showing another prior art three-conductor type filter device.
Figure 7:
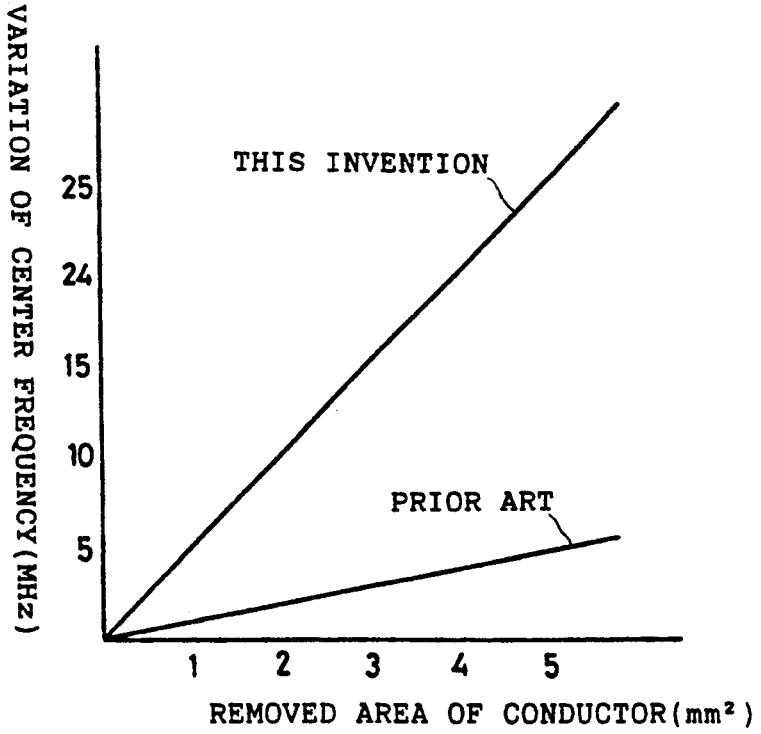
FIG. 7 is a graph showing how a center frequency of the filter adjusted in accordance with the present invention is varied by changing the area of the removed portion as compared with the case of the conventional filter device shown in FIG. 3.

FIG. 7 illustrates how the center frequency of the filter adjusted in accordance with the present invention is varied by changing the removing area as compared with the case of the conventional filter device of FIG. 3. As will be seen in the graph in case of the present invention a proportional relation obtained between the removing area and the variation level of the center frequency has a gradient which is larger than that obtained in the conventional one. This means that the present invention makes it possible to widely or greatly vary the center frequency of the filter by removing the smaller area of the ground conductor portion.

By the provision of the removed portions on the portions of the peripheral surface of each substrate which correspond to the longitudinal side edge portions of the outermost resonator conductor layers, a wide adjustable range can be obtained, by which the frequency response of the filter can be widely adjusted.

As described above, according to the present invention the frequency adjusting of the filter is performed by partially removing the external ground conductor layer on the peripheral surface of each substrate at a portion which corresponds to a longitudinal side edge of each resonator conductor layer. Therefore, the present invention has an advantage that a wide adjustable range for the center frequency of the filter can be obtained by means of the provision of the removed portions of a smaller area.

Furthermore, by provision of a frequency adjusting portion along the longitudinal direction of the respective resonator conducting layer there can be obtained an advantage that the range of adjustment may be widened thereby making it easy to correct the frequency response of the filter device.

The present invention has also an advantage that a frequency adjustment can be correctly made without increasing the thickness or height of the casing.

It is to be understood that the present invention is not limited to the particular embodiments described and that numerous modifications and alterations may be made by those skilled in the art without departing from the spirit and scope of the invention.

We claim:

1. A method of adjusting a frequency response of a filter device of a three-conductor structure type including a pair of dielectric substrates each having a peripheral and outer surfaces provided with an external ground conductor layer, and a plurality of stripline resonator conductor layers sandwiched between the dielectric substrates, each resonator conductor layer having a short circuit end connected to the ground conductor layer on one lateral surface of each substrate and an open circuit end spaced from the ground conductor layer on the opposite lateral surface of each substrate, wherein said method comprises the step of partially removing the external ground conductor layer on the peripheral surface of each substrate at a portion which corresponds to a longitudinal side edge of each resonator conductor layer to form a ground conductor removed portion partially extending along the portion between the open circuit end and the short circuit end of each outer resonator conductor layer, thereby tuning the filter device for a desired frequency response.

2. A method as claimed in claim 1, wherein each of said dielectric substrates is provided with recesses on the side portions which are opposite to the longitudinal side portions of both the outermost resonator conductor layers, and each of said removed portion is formed on the associated recess.

3. A method of adjusting a frequency response of a filter device of a three-conductor structure type including a pair of dielectric substrates each having a peripheral and outer surfaces provided with an external ground conductor layer, and a plurality of stripline resonator conductor layers sandwiched between the dielectric substrates, each resonator conductor layer having a short circuit end connected to the ground conductor layer on one lateral surface of each substrate and an open circuit end spaced from the ground conductor layer on the opposite lateral surface of each substrate, wherein said method comprises the steps of partially removing the external ground conductor layer on the peripheral surface of each substrate at a portion which corresponds to a longitudinal side edge of each resonator conductor layer to form a ground conductor removed portion partially extending along the portion between the open circuit end and the short circuit end of each outer resonator conductor layer for tuning the filter device for a desired frequency response, and providing an additional conductor member on each of the removed portions for compensating any overshoot of the adjustment performed by said removing step.

4. A method as claimed in claim 3, wherein each of said dielectric substrates is provided with recesses on the side portions which are opposite to the longitudinal side portions of both the outermost resonator conductor layers, and each of said removed portion is formed on the associated recess.

5. A filter device of a three-conductor structure type comprising a pair of dielectric substrates having a peripheral and outer surfaces; an external ground conductor layer provided on the peripheral and outer surfaces of each of said dielectric substrates; a plurality of stripline resonator conductor layers sandwiched between said dielectric substrates, each resonator conductor layer having a short circuit end connected to said ground conductor layer on one lateral surface of each substrate and an open circuit end spaced from said ground conductor layer on the opposite lateral surface of each substrate, said external ground conductor layer provided on the peripheral surface of said each dielectric substrate having a portion removed therefrom which extends along a portion between the open circuit end and the short circuit end of each outer resonator conductor layer for changing a capacitance between said ground conductor layer and each of said stripline resonator conductor layers sandwiched between said dielectric substrates; and a casing for containing a filter assembly of said dielectric substrates and said resonator conductor layers, said casing having an inner height equal to the thickness of said filter assembly.

* * * * *